US007608792B1

(12) United States Patent
Tsai

(10) Patent No.: US 7,608,792 B1
(45) Date of Patent: Oct. 27, 2009

(54) MEMBRANE KEYBOARD/KEYPAD WITH ARRANGEMENT FOR UNIFORMLY LIGHTING KEYS FROM BACKGROUND

(75) Inventor: Huo-Lu Tsai, Taichung Hsien (TW)

(73) Assignee: Sunrex Technology Corp., Ta Ya Shiang (TW)

( * ) Notice: Subject to any disclaimer, the term of this patent is extended or adjusted under 35 U.S.C. 154(b) by 0 days.

(21) Appl. No.: 12/272,632

(22) Filed: Nov. 17, 2008

(51) Int. Cl.
*H01H 13/83* (2006.01)

(52) U.S. Cl. ..... 200/310; 200/314

(58) Field of Classification Search ..... 200/512, 200/517, 310, 314, 344, 345; 341/22, 23, 341/28; 345/168–170
See application file for complete search history.

(56) References Cited

U.S. PATENT DOCUMENTS 7,057,125 B1 * 6/2006 Tsai ..... 200/310
7,235,752 B1 * 6/2007 Chen et al. ..... 200/310
7,388,167 B2 * 6/2008 Liao et al. ..... 200/310
7,411,142 B2 * 8/2008 Jung et al. ..... 200/314
7,423,229 B2 * 9/2008 Chen ..... 200/314
7,462,794 B2 * 12/2008 Lee et al. ..... 200/314
7,503,683 B2 * 3/2009 Liu ..... 362/616
7,525,056 B2 * 4/2009 Chiba et al. ..... 200/314
7,535,454 B2 * 5/2009 Jasso et al. ..... 345/156

* cited by examiner

*Primary Examiner*—Michael A Friedhofer

(57) ABSTRACT

Membrane keyboard for notebook computer and membrane keypad for cellular phone are provided. For the former, the membrane keyboard includes a frame board comprising units having an aperture; transparent keys comprising a bottom peg; resilient bridge structures on the frame board secured to the bottom of the corresponding key and comprising a central opening; insulative elastic members comprising a downward stem and a top cup; a film circuit board comprising LEDs; a transparent light guide film plate on the film circuit board and comprising bottom light diffusing areas under keys and each having a conductive member raised from center of one of different cavities; and a base board with the film circuit board fastened thereon. The elastic member is secured onto the corresponding light diffusing area and is inserted through the aperture and the opening with the cup securely put on the peg so that the keys may light uniformly.

10 Claims, 8 Drawing Sheets

MEMBRANE KEYBOARD/KEYPAD WITH ARRANGEMENT FOR UNIFORMLY LIGHTING KEYS FROM BACKGROUND

BACKGROUND OF THE INVENTION

1. Field of Invention

The invention relates to membrane keyboards/keypads and more particularly to a membrane keyboard/keypad having an arrangement for uniformly lighting keys from background.

2. Description of Related Art

Membrane keyboard/keypads are widely employed by notebook computers and cellular phones. Membrane keyboard/keypads are advantageous for being thin, lightweight, and compact. However, most types of notebook computers and cellular phones are limited to operate in a bright environment only since there is no backlight device provided.

For overcoming above drawback, many prior keyboard/keypad patents with backlight arrangement are disclosed. For example, Taiwanese Utility Model Patent No. M306,689 discloses a keyboard with backlight arrangement. However, in practice it is found that keys distal the LED (light-emitting diode) based backlight arrangement are not sufficiently illuminated. That is, keys are not illuminated uniformly.

The invention described later is an outgrowth of earlier work by the inventor hereof, described in U.S. Pat. No. 6,545,232. The patent, entitled "Thin light permeable keyboard multiple switch assembly including scissors type actuator mechanisms", discloses a thin type light permeable keyboard including keys, bridge structures, a frame board, a luminescence board, a film circuit board, and a base board. Each light permeable key has a top face coated with a light permeable substrate layer, a light impermeable coating layer, and a light permeable protection layer. Each bridge structure is pivoted between each key and the frame board. The luminescence board mounted between the frame board and the film circuit board functions as a luminous member mated with the light permeable frame board, elastic members and keys to indicate the sculptured characters, symbols, numbers or patterns on the keys, thereby facilitating the user to operate the computer in a dark environment. The teachings of the patent are incorporated herein by reference.

The patent has been successfully used in a commercial application. However, in practice it is found that light emitted from the electrically powered luminescence board passing the light permeable frame board and the keys are not sufficiently lit to uniformly illuminate characters, symbols or patterns on the keys. Thus, the need for improvement still exists.

SUMMARY OF THE INVENTION

It is therefore one object of the invention to provide a membrane keyboard for a notebook computer, comprising a frame board comprising a plurality of units each having a central aperture; a plurality of transparent keys each comprising a bottom press portion; a plurality of resilient bridge structures disposed on the frame board, each of the bridge structures being secured to the bottom of the corresponding key and comprising a central opening; a plurality of resilient insulative elastic members each comprising a downward stem and a top cup-shaped member; a film circuit board comprising a plurality of LEDs; a light guide film plate formed of transparent elastomeric material, the light guide film plate being fastened on the film circuit board and comprising a plurality of light diffusing areas on the bottom, each light diffusing area being disposed a predetermined distance under the corresponding key and having a plurality of cavities and a conductive member raised downward from a center of the cavities wherein the cavities are different in terms of depth, size, and density corresponding to different distances from the LEDs; and a base board with the film circuit board fastened thereon, wherein the elastic members are secured onto the light diffusing areas respectively and are inserted through the apertures and the openings with the cup-shaped members being securely put on the press portions so that the keys are adapted to light uniformly when the notebook computer is activated.

It is another object of the invention to provide a membrane keypad for a cellular phone, comprising a frame board comprising a plurality of spring depressible keys formed of transparent material, each key comprising a bottom press portion; a film circuit board comprising a plurality of LEDs; and a light guide film plate formed of a transparent elastomeric material, the light guide film plate being fastened on the film circuit board and comprising a plurality of light diffusing areas on the bottom, each light diffusing area being disposed a predetermined distance under the corresponding key and having a plurality of cavities and a conductive member raised downward from a center of the cavities wherein the cavities are different in terms of depth, size, and density corresponding to different distances from the LEDs, wherein the frame board is disposed above the light guide film plate with the press portions being aligned with the conductive members so that the keys are adapted to light uniformly when the cellular phone is activated.

The above and other objects, features and advantages of the invention will become apparent from the following detailed description taken with the accompanying drawings.

DETAILED DESCRIPTION OF THE INVENTION

Figure 1:
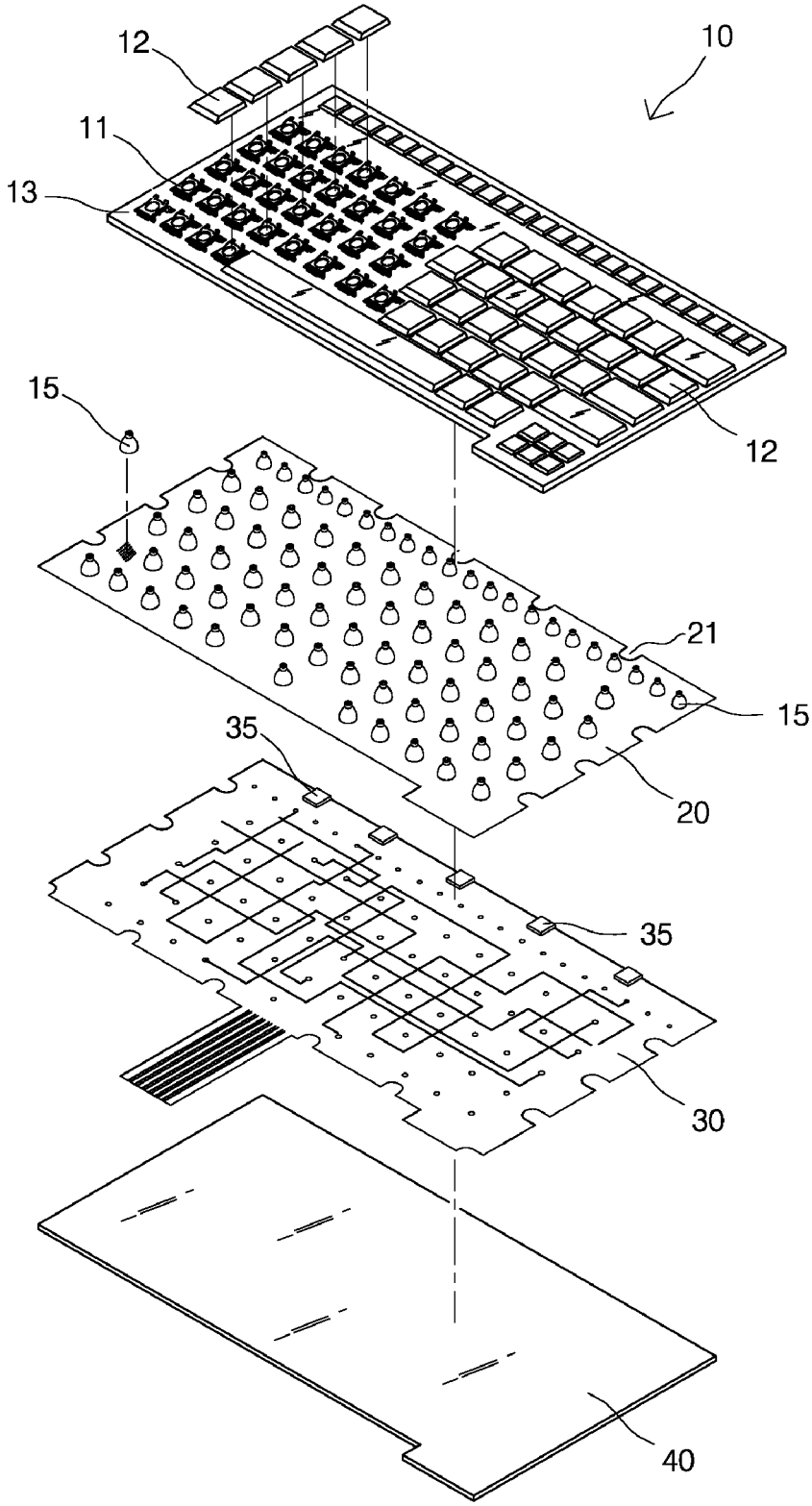
FIG. 1 is an exploded view of a first preferred embodiment of membrane keyboard for notebook computer according to the invention.
Figure 2:
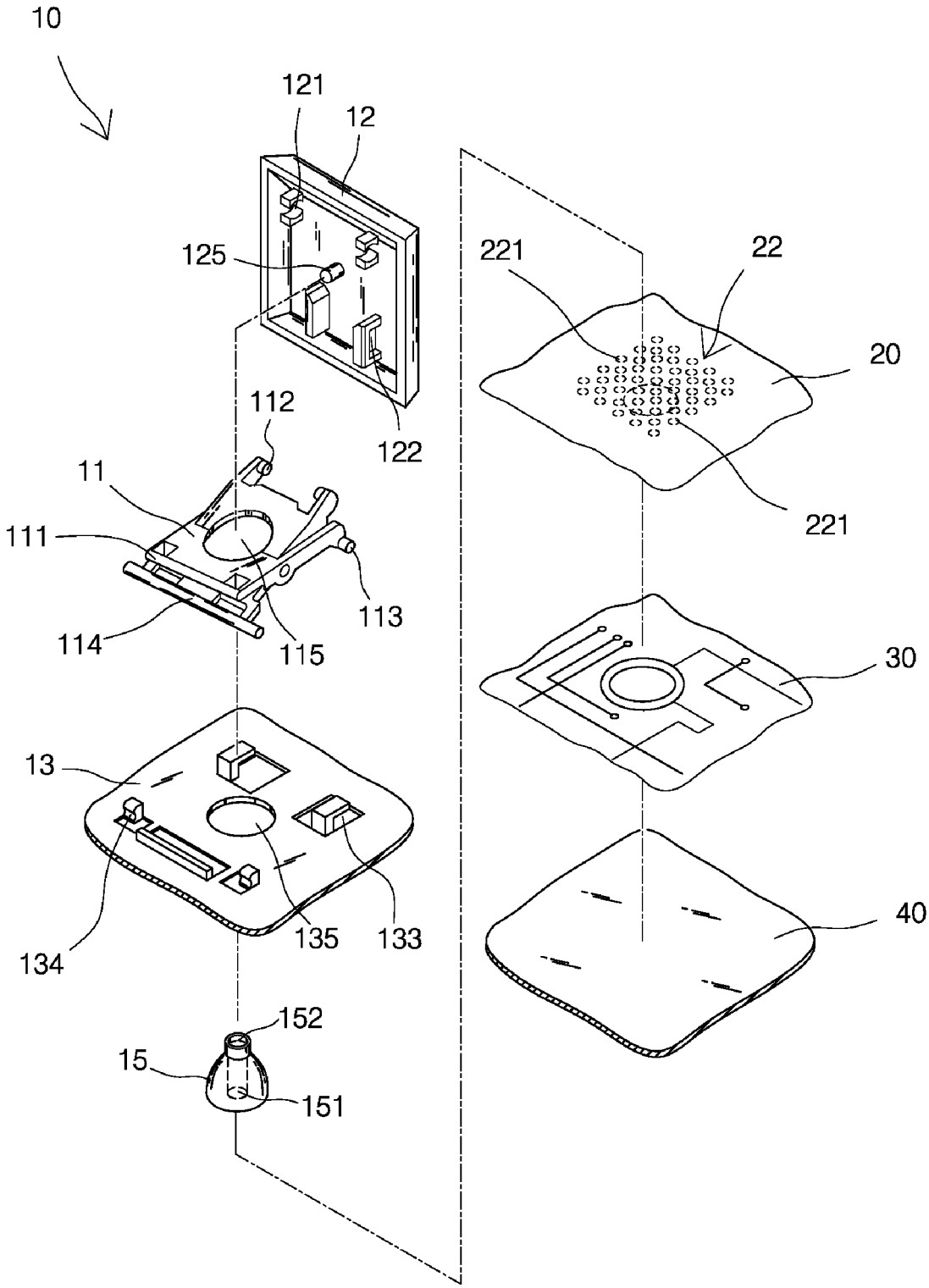
FIG. 2 is a fragmentary view of FIG. 1 depicting details of a single key construction.
Figure 3:
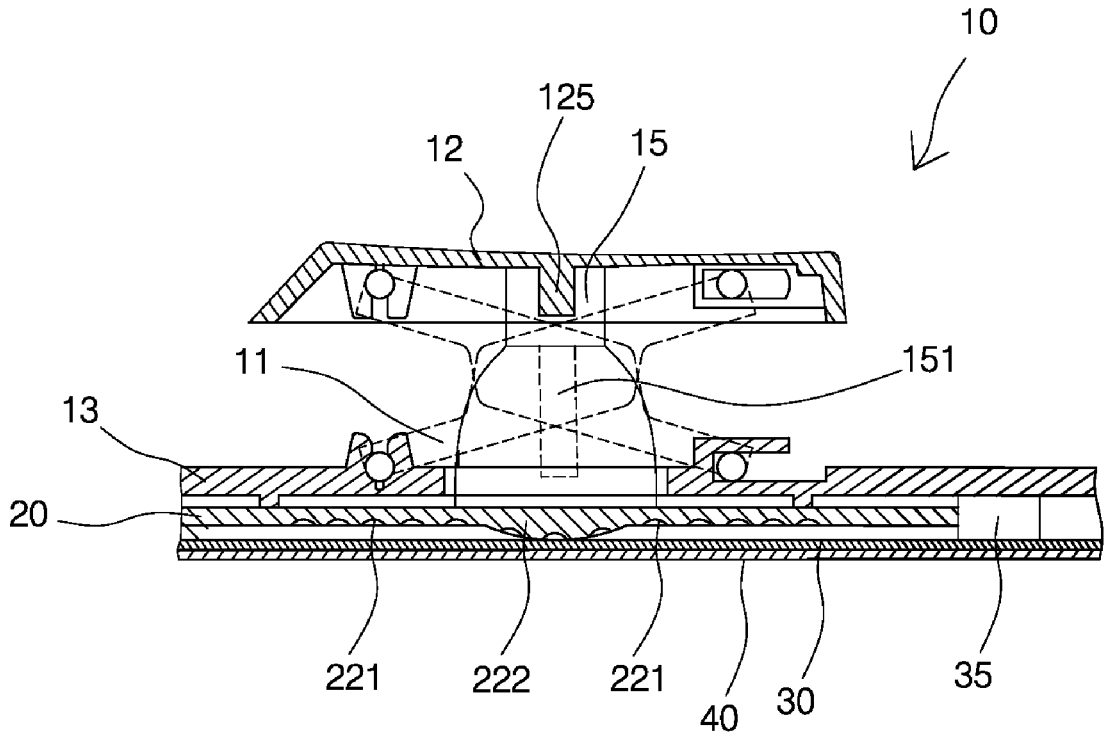
FIG. 3 is a longitudinal sectional view of FIG. 2.
Figure 4:
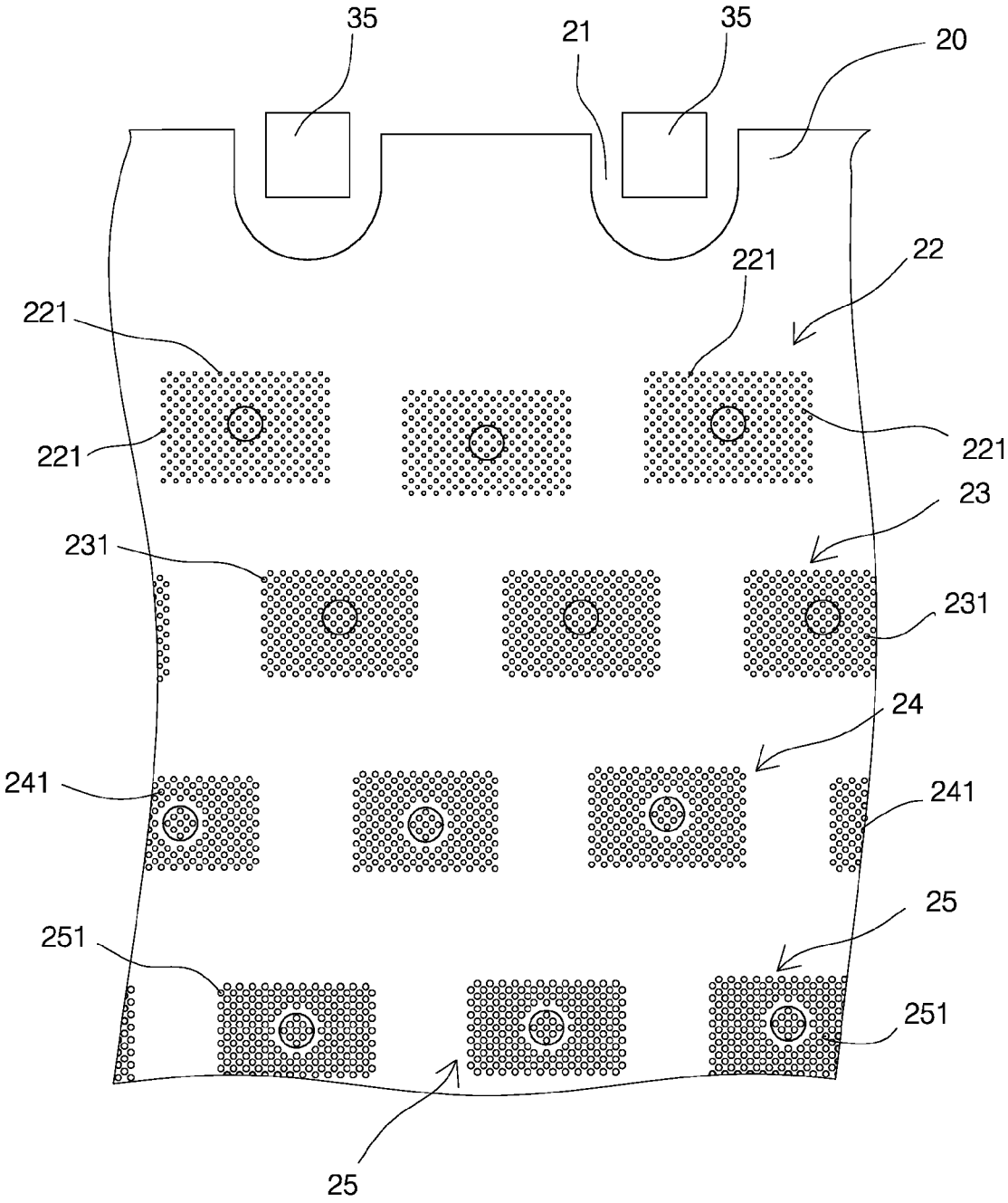
FIG. 4 is a schematic, fragmentary top view of the light guide film plate of FIG. 1 with elastic members removed.

Referring to FIGS. 1 to 5, a membrane keyboard 10 according to a first preferred embodiment of the invention is shown. The membrane keyboard 10 is for notebook computer and comprises the following components as discussed in detail below.

A substantially rectangular frame board 13 comprises a plurality of units (not numbered) each having two snapping grooves 134, two slide guide grooves 133 together arranged at four corners of a virtual square, and a circular hole 135 through the center of the square.

A plurality of transparent keys 12 each has a square top surface. On the bottom of the key 12 there are provided two pivot grooves 121, two slide guide grooves 122 together arranged proximate four corners of the bottom, and a press portion 125 extending downward from the bottom center.

A plurality of substantially rectangular bridge structures 11 each has a cross-section of "X" and comprises two first slide axles 112 at two corners of a first frame (not number), two second slide axles 113 at two corners of a second frame (not number) pivotal about the first frame, the second slide axles 113 being below the first slide axles 112, a first pivot shaft 111 at the opposite side of the second frame, a second pivot shaft 114 at the other side of the first frame parallel to and below the first pivot shaft 111, and a central circular hole 115. The first pivot shaft 111 is rotatably secured to the pivot grooves 121 and the first slide axles 112 are slidably secured to the slide guide grooves 122 respectively. The second slide axles 113 are slidably secured to the slide guide grooves 133 and the second pivot shaft 114 are rotatably secured to the snapping grooves 134 respectively.

A plurality of dome-shaped elastic members 15 are formed of a flexible insulative material (e.g., elastomeric material). The elastic member 15 comprises a downward stem 151 and a top cup-shaped member 152.

A film circuit board 30 comprises circuitry and a plurality of spaced LEDs 35 at one side, the LEDs 35 being electrically connected to the circuitry.

A light guide film plate 20 is formed of transparent silicone rubber and comprises a plurality of different light diffusing areas 22, 23, 24, and 25 on the bottom. Each light diffusing area 22, 23, 24, or 25 is disposed a predetermined short distance right below a corresponding one of the keys 12. The number of the light diffusing areas 22, 23, 24, and 25 is the same as that of the keys 12. Further, the light diffusing areas 22, 23, 24, and 25 and the keys 12 are substantially rectangular. Furthermore, each of the light diffusing areas 22, 23, 24, and 25 and its corresponding key 12 substantially have the same area. Each light diffusing area 22, 23, 24, or 25 includes a plurality of cavities 221, 231, 241, or 251 and a conductive member 222, 232, 242, or 252 raised downward from a center of the cavities 221, 231, 241, or 251 respectively. Each conductive member 222, 232, 242, or 252 is shaped as a dome. The light guide film plate 20 further includes a plurality of recesses 21 at one side. A substantially rectangular base board 40 is provided.

Figure 5:
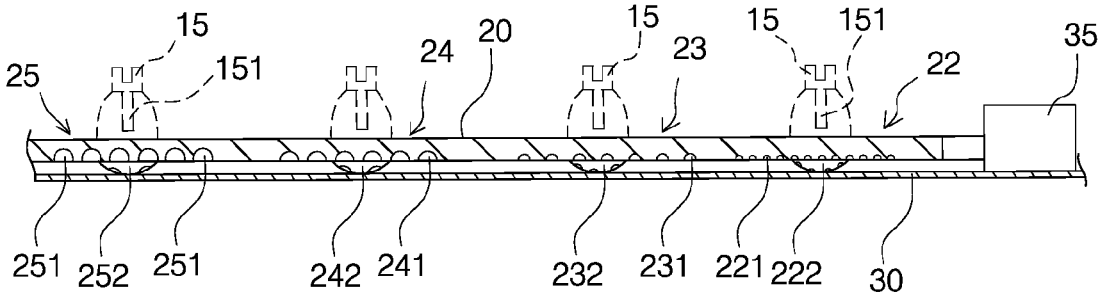
FIG. 5 is a schematic, fragmentary longitudinal sectional view of the assembled light guide film plate, film circuit board, and elastic members for showing different arrangements for emitting sufficient light to each key.

An assembly of the invention will be described in detail below. The film circuit board 30 is secured onto the base board 40. The light guide film plate 20 is secured onto the film circuit board 30 with the LEDs 35 projecting out of the recesses 21. As shown in FIG. 5, the cavities 221, 231, 241, and 251 are different in terms of depth, size, and density corresponding to different distances from the LEDs 35. This can ensure that light emitted by the LEDs 35 is substantially uniformly directed upward toward the key 12 through the light diffusing areas 22, 23, 24, and 25. Hence, the keys 12 are lit uniformly when the notebook computer is turned on. The elastic members 15 are secured onto the light diffusing areas 22, 23, 24, and 25 respectively. The elastic members 15 are inserted through the holes 135 and the holes 115 sequentially with the cup-shaped members 152 snugly put on the press portions 125. The press portions 125 are thus aligned with the stems 151.

In use, a user may press the key 12 to push down the stem 151 with the bridge structure 11 being elastically compressed until the conductive member 222, 232, 242, or 252 presses the film circuit board 30. As a result, a switch is "closed" and the depressed key is activated. It is understood that a release of the key 12 will elastically return the key 12 to its rest position.

Figure 6:
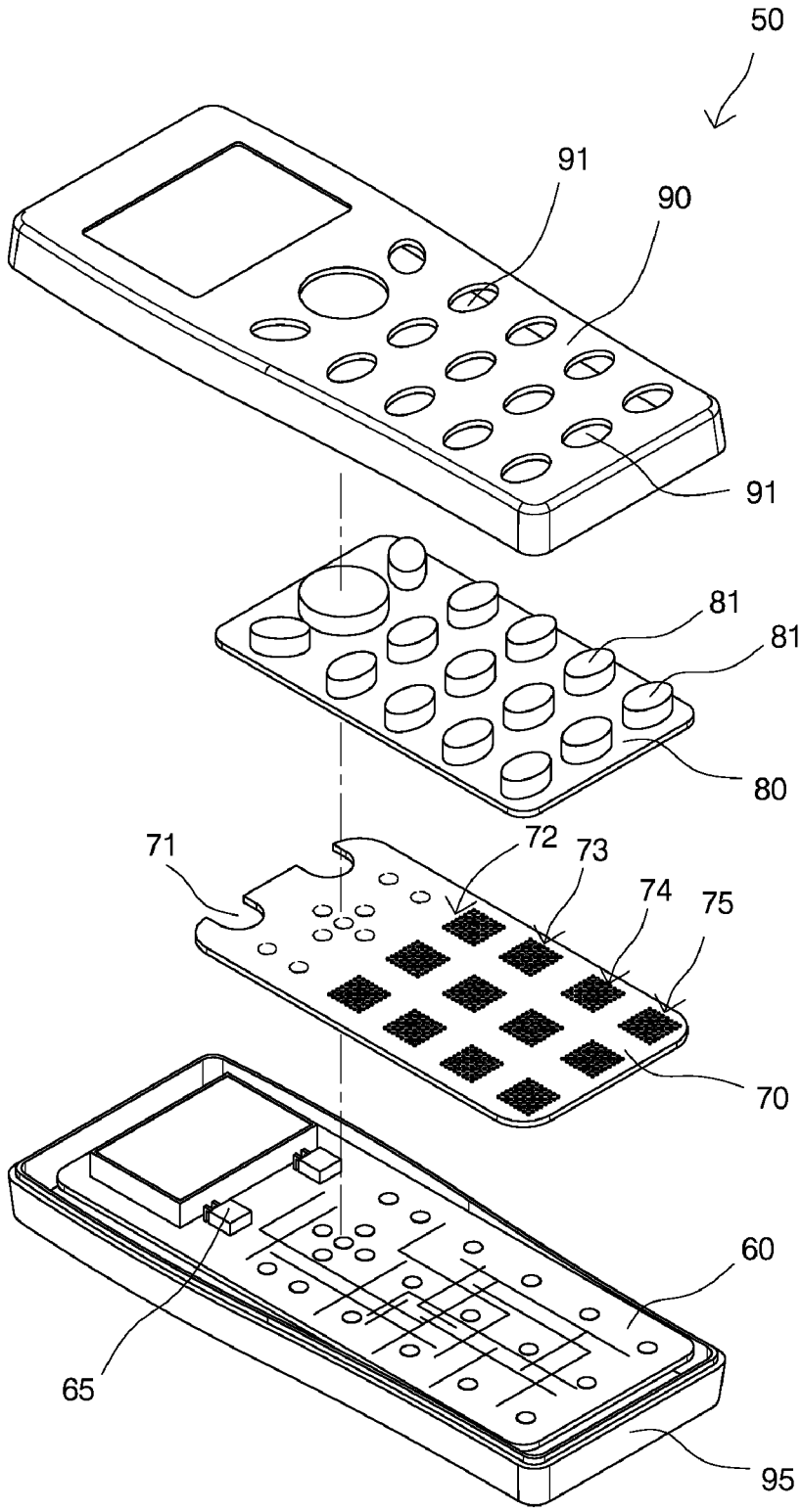
FIG. 6 is an exploded view of a cellular phone incorporating a second preferred embodiment of membrane keypad according to the invention.
Figure 7:
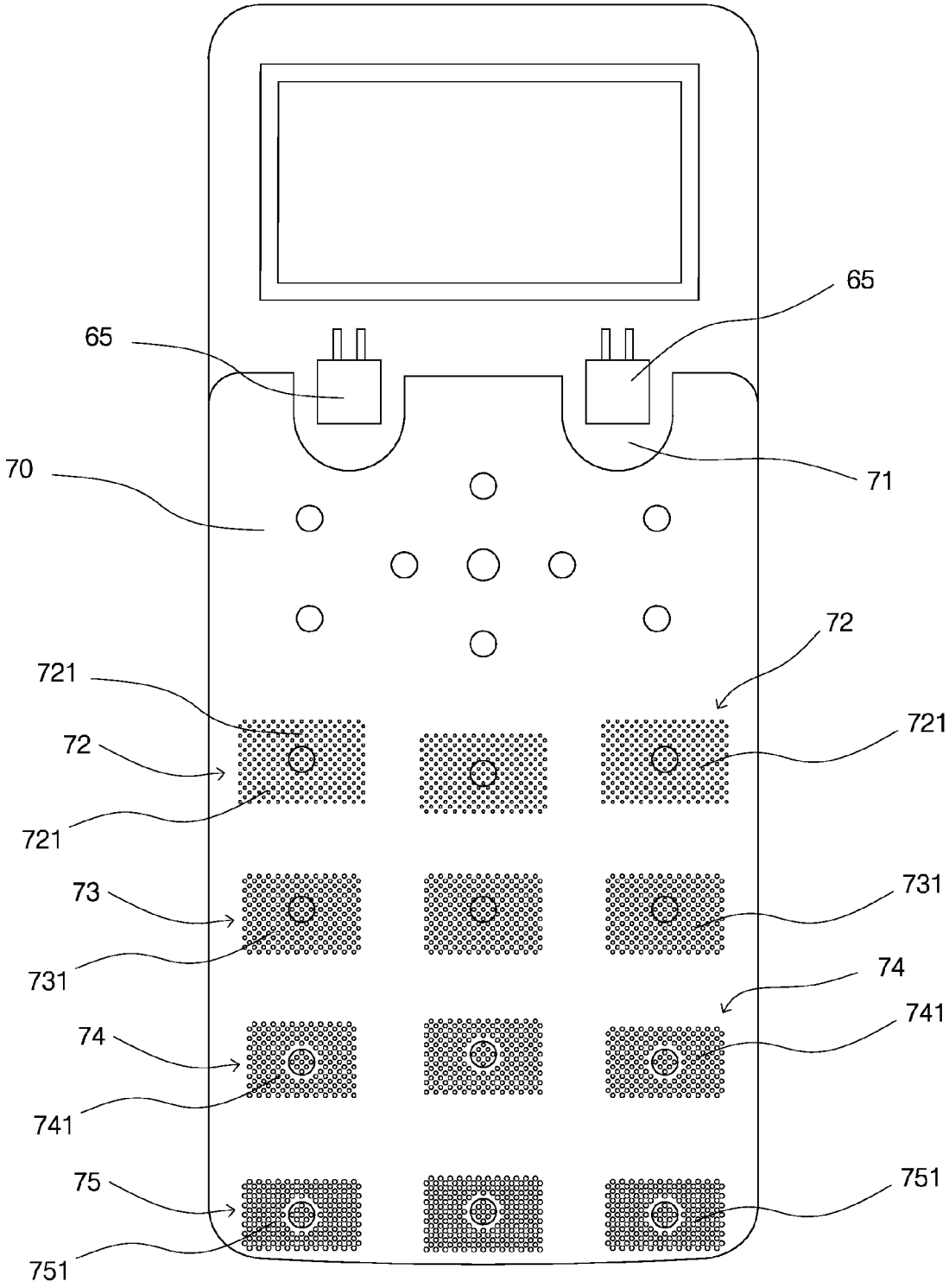
FIG. 7 is a top view of the assembled light guide film plate and phone body of FIG. 6.
Figure 8:
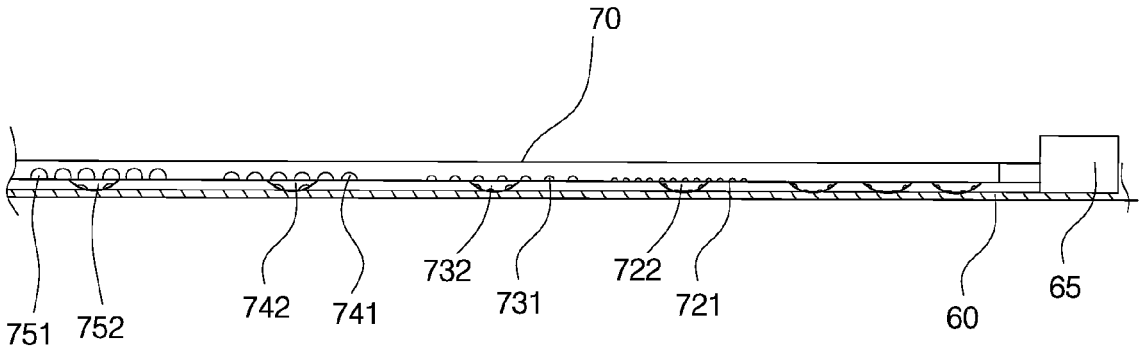
FIG. 8 is a schematic, fragmentary longitudinal sectional view of the assembled light guide film plate and film circuit board for showing different arrangements for emitting sufficient light to each key.

Referring to FIGS. 6 to 8, a membrane keypad according to a second preferred embodiment of the invention is shown. The membrane keypad is for a cellular phone 50 and comprises the following components as discussed in detail below.

A phone cover 90 comprises a plurality of key apertures 91. A substantially rectangular frame board 80 comprises a plurality of spring depressible keys 81 formed of transparent material. Each key 81 projects out of the key aperture 91. The key 81 comprises a downward extending stem (not shown).

A film circuit board 60 is mounted in a phone body 95 and comprises circuitry and two spaced LEDs 65, the LEDs 65 being electrically connected to the circuitry.

A light guide film plate 70 is formed of transparent silicone rubber and comprises a plurality of different light diffusing areas 72, 73, 74, and 75 on the bottom. Each light diffusing area 72, 73, 74, or 75 is disposed a predetermined short distance right below a corresponding one of the keys 81. The number of the light diffusing areas 72, 73, 74, and 75 is the same as that of the keys 81. The keys 81 are oval. Further, the light diffusing areas 72, 73, 74, and 75 are substantially rectangular. Furthermore, each of the light diffusing areas 72, 73, 74, and 75 is aligned with its corresponding key 81. Each light diffusing area 72, 73, 74, or 75 includes a plurality of cavities 721, 731, 741, or 751 and a conductive member 722, 732, 742, or 752 raised downward from a center of the cavities 721, 731, 741, or 751 respectively. Each conductive member 722, 732, 742, or 752 is shaped as a dome. The light guide film plate 70 further includes a plurality of recesses 71 at one side.

An assembly of the invention will be described in detail below. The light guide film plate 70 is secured onto the film circuit board 60 with the LEDs 65 projecting out of the recesses 71. As shown in FIGS. 7 and 8, the cavities 721, 731, 741, and 751 are different in terms of depth, size, and density corresponding to different distances from the LEDs 65. This can ensure that light emitted by the LEDs 65 is substantially uniformly directed upward toward the keys 81 through the light diffusing areas 72, 73, 74, and 75 when the cellular phone is turned on. Hence, the keys 81 are lit uniformly.

In use, a user may press the key 81 to push down its stem until the conductive member 722, 732, 742, or 752 presses the film circuit board 60. As a result, a switch is "closed" and the depressed key 81 is activated. It is understood that a release of the key 81 will elastically return the key 81 to its rest position.

While the invention herein disclosed has been described by means of specific embodiments, numerous modifications and variations could be made thereto by those skilled in the art without departing from the scope and spirit of the invention set forth in the claims.

What is claimed is:

1. A membrane keyboard for a notebook computer, comprising:

a frame board comprising a plurality of units each having a central aperture;

a plurality of transparent keys each comprising a bottom press portion;

a plurality of resilient bridge structures disposed on the frame board, each of the bridge structures being secured to the bottom of the corresponding key and comprising a central opening;

a plurality of resilient insulative elastic members each comprising a downward stem and a top cup-shaped member;

a film circuit board comprising a plurality of LEDs;

a light guide film plate formed of transparent elastomeric material, the light guide film plate being fastened on the film circuit board and comprising a plurality of light diffusing areas on the bottom, each light diffusing area being disposed a predetermined distance under the corresponding key and having a plurality of cavities and a conductive member raised downward from a center of the cavities wherein the cavities are different in terms of depth, size, and density corresponding to different distances from the LEDs; and a base board with the film circuit board fastened thereon, wherein the elastic members are secured onto the light diffusing areas respectively and are inserted through the apertures and the openings with the cup-shaped members being securely put on the press portions so that the keys are adapted to light uniformly when the notebook computer is activated.

2. The membrane keyboard of claim 1, wherein the key is adapted to press to push down the stem with the bridge structure being elastically compressed to electrically interconnect the conductive member and the film circuit board.

3. The membrane keyboard of claim 1, wherein the number of the keys and that of the light diffusing areas are the same.

4. The membrane keyboard of claim 1, wherein the shape of each key and that of each light diffusing area are substantially rectangular of about the same area.

5. The membrane keyboard of claim 1, wherein the bridge structure has a cross-section of "X".

6. The membrane keyboard of claim 1, wherein the LEDs are disposed at an edge of the light guide film plate.

7. A membrane keypad for a cellular phone, comprising:

a frame board comprising a plurality of spring depressible keys formed of transparent material, each key comprising a bottom press portion;

a film circuit board comprising a plurality of LEDs; and a light guide film plate formed of a transparent elastomeric material, the light guide film plate being fastened on the film circuit board and comprising a plurality of light diffusing areas on the bottom, each light diffusing area being disposed a predetermined distance under the corresponding key and having a plurality of cavities and a conductive member raised downward from a center of the cavities wherein the cavities are different in terms of depth, size, and density corresponding to different distances from the LEDs, wherein the frame board is disposed above the light guide film plate with the press portions being aligned with the conductive members so that the keys are adapted to light uniformly when the cellular phone is activated.

8. The membrane keyboard of claim 7, wherein the key is adapted to press the press portion to electrically interconnect the conductive member and the film circuit board.

9. The membrane keyboard of claim 7, wherein the number of the keys and that of the light diffusing areas are the same.

10. The membrane keyboard of claim 7, wherein the LEDs are disposed at an edge of the light guide film plate.

* * * * *